US011002076B2

(12) United States Patent
Slaughter, Jr. et al.

(10) Patent No.: US 11,002,076 B2
(45) Date of Patent: May 11, 2021

(54) DUAL-MEMBER PIPE ASSEMBLY

(71) Applicant: The Charles Machine Works, Inc., Perry, OK (US)

(72) Inventors: Greg L. Slaughter, Jr., Perry, OK (US); Joseph G. Greenlee, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 24 days.

(21) Appl. No.: 16/371,300

(22) Filed: Apr. 1, 2019

(65) Prior Publication Data

US 2019/0226283 A1 Jul. 25, 2019

Related U.S. Application Data

(63) Continuation of application No. 15/052,387, filed on Feb. 24, 2016, now Pat. No. 10,260,287.

(60) Provisional application No. 62/120,111, filed on Feb. 24, 2015.

(51) Int. Cl.

| | |
|---|---|
| ***E21B 7/04*** | (2006.01) |
| ***E21B 7/00*** | (2006.01) |
| ***E21B 17/00*** | (2006.01) |

(52) U.S. Cl.

CPC ..... *E21B 7/046* (2013.01); *E21B 7/002* (2013.01); *E21B 17/00* (2013.01)

(58) Field of Classification Search

CPC ..... E21B 17/00; E21B 7/002

See application file for complete search history.

(56) References Cited

U.S. PATENT DOCUMENTS

| | | | | |
|---|---|---|---|---|
| 1,693,017 | A | 11/1928 | Bartholomae | |
| 3,926,265 | A | 12/1975 | Bouyoucos | |
| 4,067,596 | A | 1/1978 | Kellner et al. | |
| 4,396,076 | A * | 8/1983 | Inoue | E21B 10/32 175/265 |
| 4,597,454 | A | 7/1986 | Schoeffler | |
| 4,732,223 | A | 3/1988 | Schoeffler et al. | |
| 4,940,098 | A | 7/1990 | Moss | |
| 5,484,029 | A | 1/1996 | Eddison | |
| 5,490,569 | A | 2/1996 | Brotherton et al. | |
| 5,682,956 | A | 11/1997 | Deken et al. | |
| RE38,418 | E * | 2/2004 | Deken | E21B 6/00 175/19 |
| 6,739,413 | B2 | 5/2004 | Sharp et al. | |
| 6,827,158 | B1 | 12/2004 | Dimitroff | |
| 7,152,700 | B2 | 12/2006 | Church et al. | |
| 7,216,724 | B2 | 5/2007 | Self et al. | |

(Continued)

OTHER PUBLICATIONS

United States Patent and Trademark Office, "Office Action Summary", dated Aug. 30, 2012, 10 pages, Alexandria, Virginia.

*Primary Examiner* — Giovanna Wright
*Assistant Examiner* — Dany E Akakpo
(74) *Attorney, Agent, or Firm* — Tomlinson McKinstry, P.C.

(57) ABSTRACT

A pipe assembly used in horizontal directional drilling operations. The pipe assembly has an outer member, an inner member, and first removable collar. The inner member has a polygonal outer profile of uniform shape along its length and is partially contained within the outer member. The first removable collar is supported on the inner member within the outer member and limits relative axial movement of the inner member and the outer member.

22 Claims, 5 Drawing Sheets

(56) References Cited

U.S. PATENT DOCUMENTS

| | | | | |
|---|---|---|---|---|
| 7,694,753 | B2 | 4/2010 | Carlson et al. | |
| 8,201,644 | B2 | 6/2012 | Hall et al. | |
| 8,534,388 | B2 | 9/2013 | Hall et al. | |
| 9,765,574 | B2 | 9/2017 | Slaughter, Jr. et al. | |
| 9,803,433 | B2 | 10/2017 | Slaughter, Jr. et al. | |
| 10,161,199 | B2 | 12/2018 | Slaughter, Jr. et al. | |
| 2005/0029016 | A1 | 2/2005 | Self et al. | |
| 2009/0266618 | A1* | 10/2009 | Mitchell | E21B 17/105 175/325.7 |
| 2013/0068490 | A1 | 3/2013 | Van Zee et al. | |
| 2014/0305709 | A1 | 10/2014 | Slaughter, Jr. et al. | |
| 2016/0245025 | A1 | 8/2016 | Slaughter, Jr. et al. | |
| 2017/0058612 | A1* | 3/2017 | Adams | E21B 10/322 |
| 2018/0002990 | A1 | 1/2018 | Wilson et al. | |
| 2019/0040692 | A1 | 2/2019 | Slaughter, Jr. | |
| 2019/0136630 | A1 | 5/2019 | Slaughter, Jr. et al. | |

* cited by examiner

DUAL-MEMBER PIPE ASSEMBLY

FIELD

The present invention relates generally to horizontal directional drilling operations and specifically to dual-member pipe assemblies and to methods of boring horizontal boreholes using dual-member pipe assemblies.

BACKGROUND

Horizontal directional drills or boring machines may be used to install or replace underground utilities with minimal surface disruption. Horizontal directional drills may utilize single member drill strings or dual-member drill strings to create the desired borehole. Drills that use dual-member drill strings are generally considered "all-terrain" machines because they are capable of drilling through soft soil as well as rocks and rocky soil. Dual-member drill strings comprise a plurality of dual-member pipe assemblies. Each dual-member pipe assembly has an inner member supported inside an outer member. The inner member is generally rotatable independent of the outer member. The inner member may be used to rotate a boring tool supported at the end of the drill string. As used herein "boring tool" means the drill bit and housing used to support the drill bit. Such housing may be configured to support a drive shaft and a beacon. The drive shaft may be configured to connect the inner member of the drill string to drive rotation of the drill bit.

In large diameter drilling operations the inner member may be a tubular pipe section with hex ends welded to each end. However, in small diameter drilling operations the inner member must be a solid rod because of space constraints and to handle the torque and thrust forces exerted on the inner member during drilling.

The dual-member drill string permits selective rotation of the outer member to align and hold a steering feature used to change the direction of the borehole while the rotating drill bit continues to drill. One such system is described in U.S. Pat. No. 5,490,569, entitled Directional Boring Head with Deflection Shoe, the contents of which are incorporated herein by reference.

All-terrain, dual-member drill string systems have been very effective for drilling in various soil conditions. However, there are significant stresses placed on the dual-member drill string and its various components during drilling. There is also a general desire to deliver more drilling fluid to the boring tool in small diameter operations to improve cooling the boring tools and float cuttings to the surface. The dual-member pipe assembly of the present invention provides a pipe assembly that has replaceable component parts and a hollow inner member that may be used in small diameter drilling operations. The hollow inner member provides increased fluid flow to the boring tool and improved performance and durability of each pipe assembly.

SUMMARY

The present invention is directed to a pipe assembly comprising an elongate outer member, an elongate hollow outer member, and a first removable collar. The outer member has opposed first and second ends and a hollow region extending end-to-end. The inner member has opposed first and second ends and a polygonal outer profile of uniform shape along its length. The inner member is partially contained within the outer member and axially movable relative to the outer member. The first removable collar is supported on the inner member and configured to limit relative axial movement of the inner member and the outer member.

The present invention is likewise directed to a kit comprising a plurality of elongate hollow outer members, a plurality of elongate hollow inner members, and a plurality of first removable collars. Each inner member is disposed within an associated hollow outer member and axially moveable relative to that outer member. Each inner member has opposed first and second ends and a polygonal outer profile of uniform shape along its length. Each first removable collar is sized to closely fit around an associated inner member and is positioned to limit relative axial movement of that inner member and its associated outer member.

The present invention is also directed to a system comprising a drill string, a plurality of pipe assemblies, a horizontal directional drilling machine, and a boring tool. The horizontal directional drilling machine is operatively engaged to the drill string at its first end. The boring tool is operatively engaged to the drill string at its second end. The plurality of the pipe assemblies each comprise an elongate outer member, elongate hollow inner member, and a first removable collar. The outer member has opposed first and second ends and a hollow region extending end to end. The inner member has opposed first and second ends and a polygonal outer profile of uniform shape along its length. The inner member is partially contained within the outer member and axially movable relative to the outer member. The first removable collar is supported on the inner member and configured to limit relative axial movement of the inner member and the outer member. The pipe assemblies are arranged in end-to-end relationship such that the outer members of the pipe assemblies form a torque-transmitting outer drive train and the inner members form a torque-transmitting inner drive train that is rotatable independently of the outer drive train.

DETAILED DESCRIPTION

Figure 1:
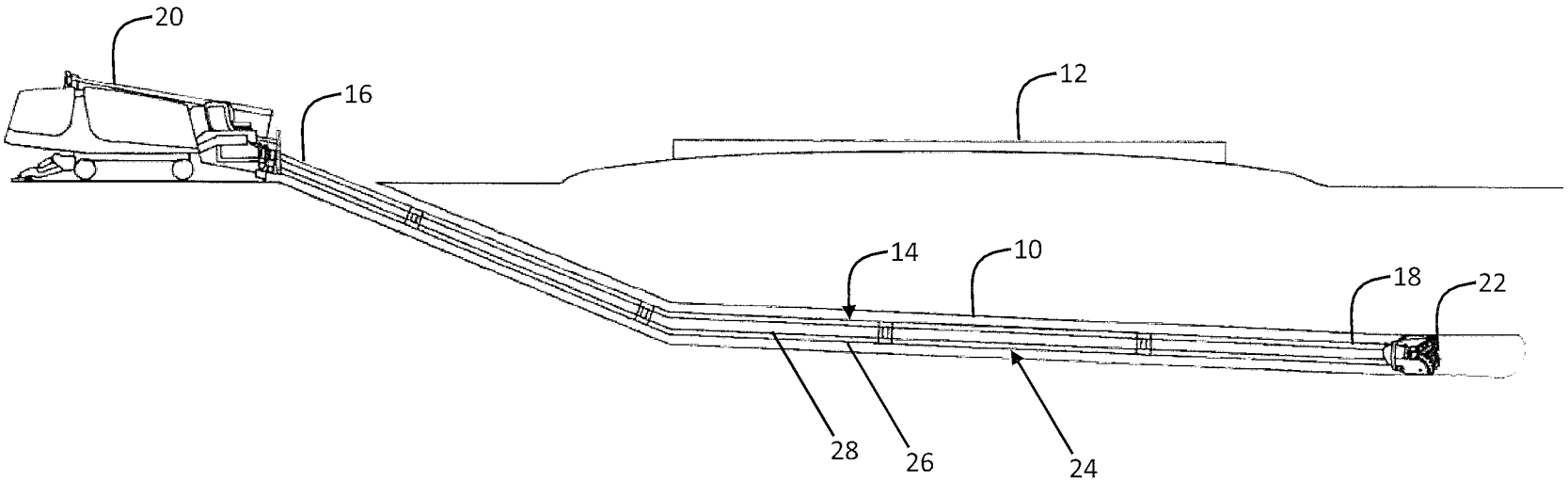
FIG. 1 is a diagrammatic representation of an HDD system shown drilling a pilot bore under a roadway using the dual-member pipe assembly of the present invention.

Turning now to FIG. 1, shown therein is a typical horizontal directional drilling (hereinafter "HDD") operation to create a pilot bore 10 under an above-ground obstacle, such as roadway 12. FIG. 1 shows the use of a dual-member drill string 14 having a first end 16 and a second end 18. The drill string transmits thrust and rotation force from the HDD machine 20 to the boring tool 22. Thus, the drill string 14 is operatively engaged to the HDD machine 20 at its first end 16 and the boring tool 22 at its second end 18.

The dual-member drill string 14 is made-up of a plurality of pipe assemblies 24. The pipe assemblies 24 are arranged in end-to-end relationship such that a plurality of outer members 26 forms a torque-transmitting outer drive train and the plurality of inner members 28 form a torque-transmitting inner drive train. The HDD machine 20 comprises a drive system configured to drive independent rotation of the inner and outer drive trains. The HDD machine 20 and pipe assemblies 24 are configured such that the outer drive train is selectively rotatable to position a steering feature while the inner drive train rotates the drill bit. Thrust is imparted to the boring tool 22 through both the inner and outer drive trains.

Figure 2:
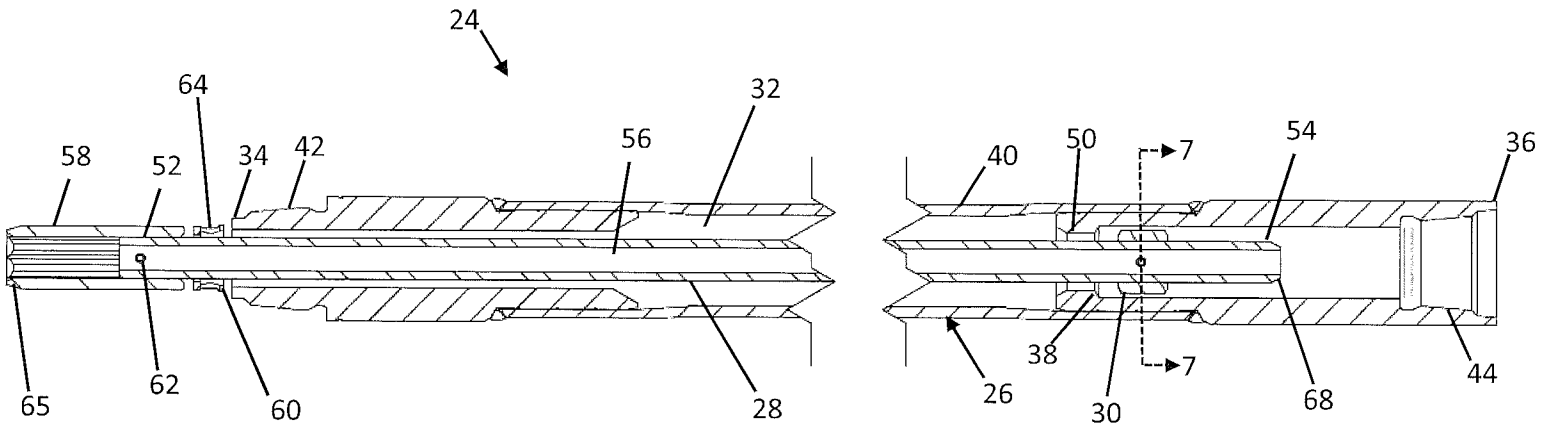
FIG. 2 is an illustration of a preferred embodiment of a dual-member pipe assembly from the dual-member drill string shown in FIG. 1.

With reference now to FIG. 2, a pipe assembly 24 from the dual-member drill string 14 of FIG. 1 is shown in more detail. The pipe assembly 24 comprises elongate outer member 26, elongate hollow inner member 28, and a first removable collar 30. The outer member has a hollow region 32 that extends along its length from its first end 34 to its second end 36. The hollow region 32 is defined by central body 40, pin 42, and box 44. The central body 40 is preferably an elongate, hollow cylinder. In FIG. 2, the central body has a portion removed for the purposes of illustration. However, the central body 40 may preferably have a length up to fifteen (15) feet. The pin 42 is at the first end 34 of the outer member and is press fit and welded into the central body 40. The pin 42 may have external threads 46 (FIG. 8) configured to connect the first end 34 of the outer member 26 to either the drive system of the HDD machine 20 or the box 44 of an adjacent outer member. The pin 42 is hollow to permit fluid to flow through the annular space formed between the inner member 28 and the outer member 26.

The box 44 is press fit and welded to the body 40 at the second end 36 of the outer member 26. The box may have internal threads 48 (FIG. 8) configured to pair with threads 46 to arrange the plurality of outer members of the drill string into the outer drive train. The box 44 is hollow and in fluid communication with the body 40 and the pin 42. The portion of the box 44 pressed into the body 40 has an axial fluid flow passage 50 that defines an annular shoulder 38. The hollow pin 42, body 40, fluid passage 50, and box 44 all define the hollow region 32 that extends from the first end 34 to the second end 36 of the outer member 26.

Figure 3:
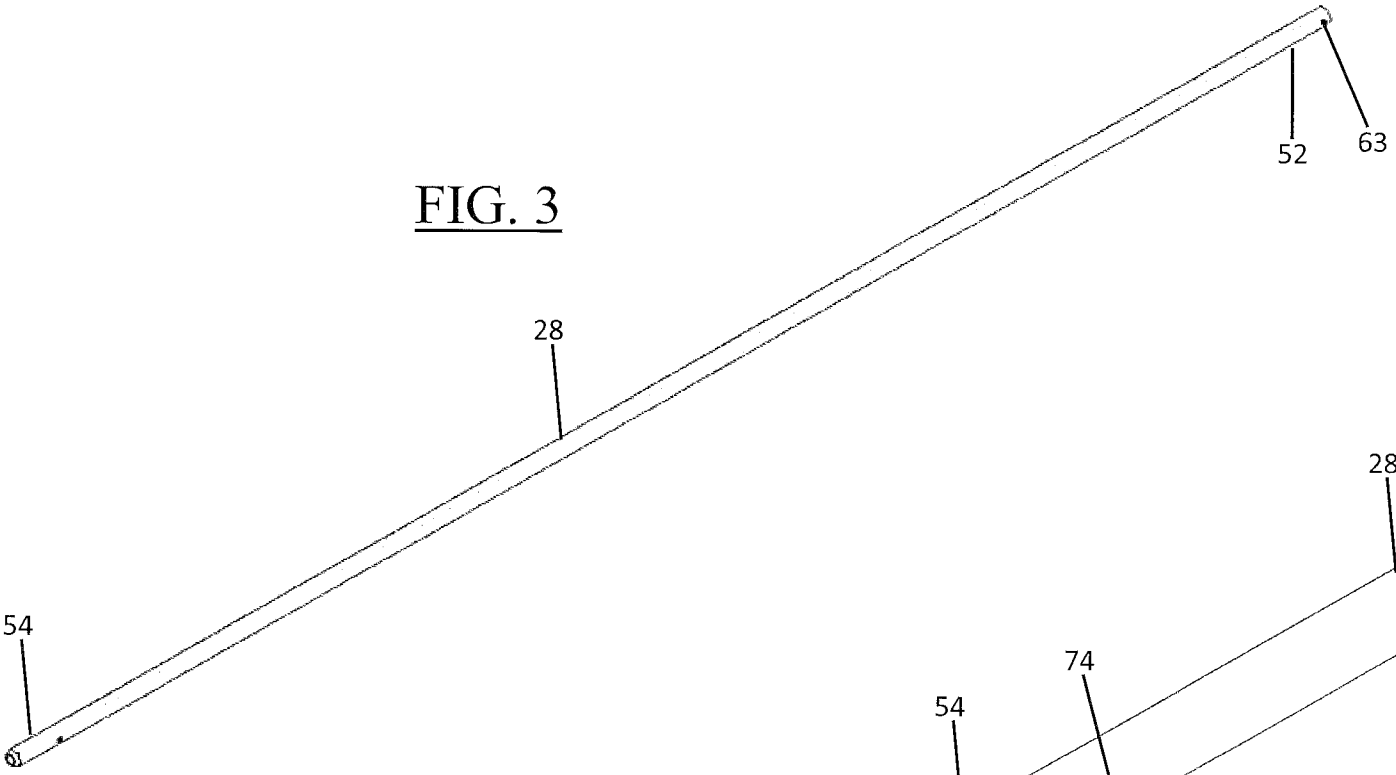
FIG. 3 is a perspective view of the inner member of the dual-member pipe assembly.
Figure 4:
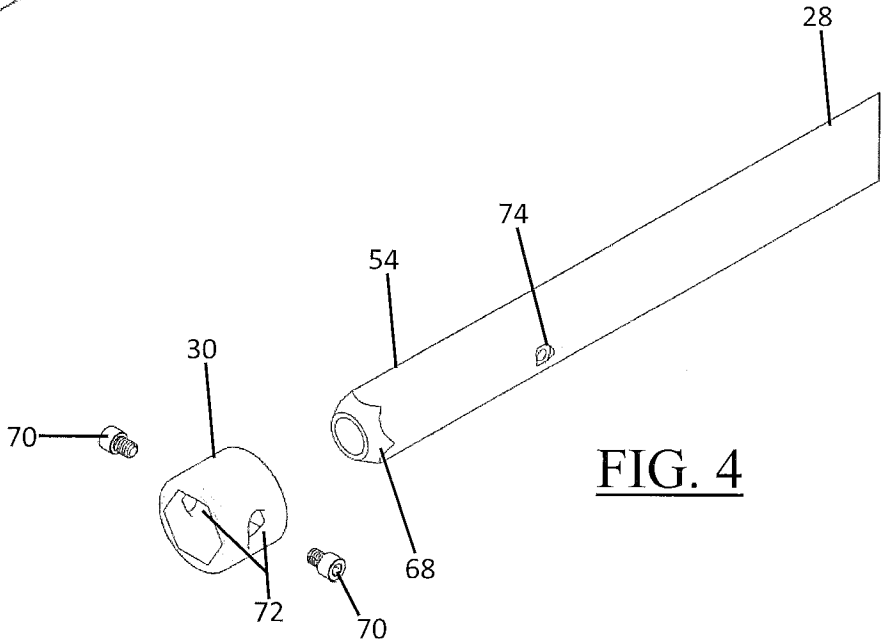
FIG. 4 is an enlarged; partially exploded, view of the second end of the inner member showing the first removable collar.

With reference now to FIGS. 2, 3, 4, and 8 the inner member 28 will be described. The inner member 28 is tubular and has opposed first 52 and second 54 ends. The first end 52 of the inner member 28 may project from the first end 34 of the outer member 26. The inner member 28 has a polygonal outer profile and a hollow region 56 with a circular cross-sectional profile. As shown in FIG. 3 the polygonal outer profile is of uniform shape along the length of the inner member. The polygonal outer profile may also be of uniform size along the length of the inner member. However, one skilled in the art will appreciate that an inner member 28 configured to have a larger dimension at the first end 52 and a smaller dimension at the second end 54 may be used in the pipe assembly 24. In such case, the inner member may have a polygonal profile configured to pair with its outer profile and the first end 52 may be sized to receive the second end 54 therein.

A polygonal outer profile that allows torque transmission between inner members 28 of the inner drive train is selected. Preferably, the polygonal outer profile is a regular hexagon. However, one skilled in the art will appreciate the outer profile could be a triangle, quadrilateral, or another polygon profile that permits torque transmission from one inner member to another through sleeve 58. The hollow region 56 has a circular profile configured to permit the unobstructed flow of drilling fluid along the inside of the inner member 28. However, the profile of the hollow region 56 could closely resemble the outer profile of the inner member. For example, the inner member may have an outer profile that is a regular hexagon and an inner profile that is also a regular hexagon.

A sleeve 58 is positioned on the inner member 28 at its projecting first end 52 adjacent to the first end 34 of the outer member 26. The sleeve 58 may be fastened to the inner member 28 with a roll pin or other fastener secured in hole 62 and inner member hole 63. The sleeve 58 has opposed first and second ends and a polygonal inner profile that closely conforms to the outer profile of the inner member 28. The polygonal inner profile of the sleeve extends end-to-end. In the embodiment discussed herein, the inner profile of the sleeve is a regular hexagon configured to receive a pair of inner members 28 within its opposed ends. The polygonal outer profile of the inner member and the polygonal inner profile of the sleeve permit the connection of the inner members 28 in a single-action, "slip-fit" connection, or "connector-free" engagement. An end of the sleeve 58 may have a taper 65 to assist in guiding the sleeve into the box 44 of the outer member 26.

A second collar 60 surrounds the inner member 28 and is situated between the sleeve 58 and the first end 34 of the outer member 26. The second collar 60 has an outer profile dimension configured to limit relative axial movement of the inner member 28 and the outer member 26. One skilled in the art will appreciate that the pipe assembly 24 may be used without the second collar 60. In such case the sleeve 58 may engage the first end 34 of the outer member 26 to limit axial movement of the inner member 28 relative the outer member when the inner member has moved in a second direction. The second collar 60 has an inner profile that closely conforms to the outer profile of the inner member 28. Accordingly, second collar 60 may have a hexagonal inner profile to pair with the hexagonal outer profile of the inner member 28. However, the outer profile of the second collar 60 may be circular and configured to provide a bearing surface between the inner member 28 and the outer member 26. Outer profile of the second collar 60 may also assist to center the inner member 28 within the outer member 26.

Figure 8:
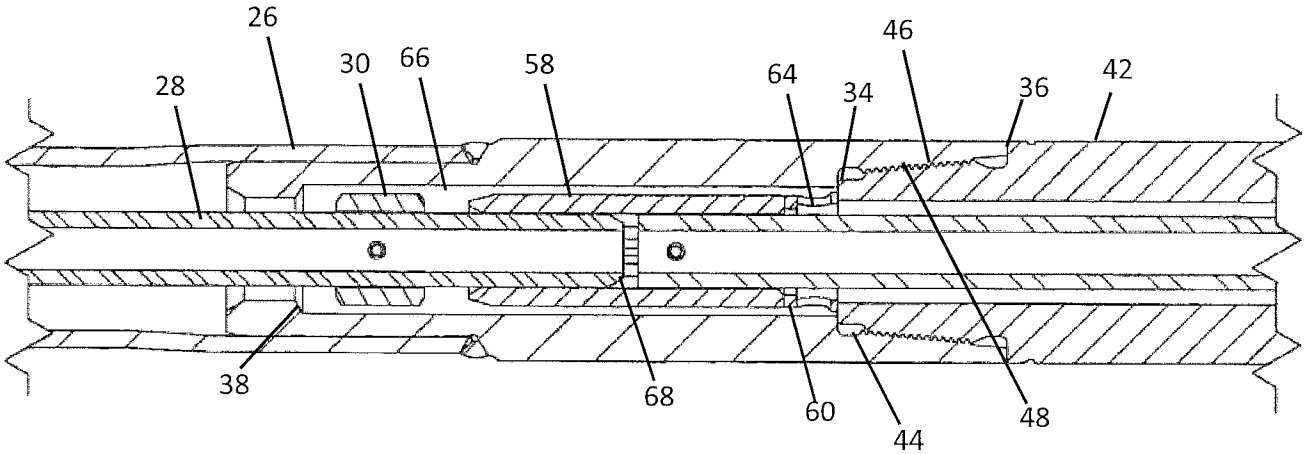
FIG. 8 is a partially cut-away view of a pipe joint comprising a dual-member pipe assembly connected to an adjacent dual-member pipe assembly.

Drilling fluid flows along an annular space 66 (FIG. 8) formed between the inner member 28 and the outer member 26. The flow of fluid along the annular space 66 may be restricted or cut-off completely when the second collar 60 engages the first end 34 of the outer member 26, as shown in FIG. 8. Therefore, the second collar 60 may have fluid passages 64 to allow the axial flow of drilling fluid along the annular space 66.

Continuing with FIGS. 2, 3, 4, and 8 the second end 54 of the inner member 28 does not project from the outer member 26. Rather, the second end 54 is positioned within the outer member 26 adjacent its second end 36, inside box 44. The second end 54 may have a frustoconical guide 68 configured to guide the inner member into the sleeve 58. One skilled in the art will appreciate that both the first end 52 and the second end 54 may have frustoconical guides.

First removable collar 30 is supported on the inner member 28 within the outer member 26 adjacent its second end 54. The collar 30 may have a circular outer profile and an inner profile sized to closely fit around the inner member 28. As disclosed herein, the inner profile may be hexagonal to pair with the hexagonal outer profile of the inner member 28. In assembly, the collar 30 is slid onto the inner member 28 and secured thereto with fasteners 70. The fasteners may be hex screws sized to fit within counter bores 72 formed in the collar 30. Preferably, two counter bores 72 are formed in the collar 30 and arranged to align with holes 74 cut into the inner member 28 to each receive a fastener 70. Counter bores 72 are preferable so the fasteners will be flush with, or below the outer profile of the collar 30 (see FIG. 7).

The first collar 30 has a maximum cross-sectional dimension that exceeds a maximum cross-sectional dimension of the hollow region 32 of the outer member 26. For example, the first collar 30 may have a maximum cross-sectional dimension, diameter, greater than the cross-sectional dimension of fluid passage 50. Accordingly, collar 30 will engage the annular shoulder 38 of the outer member 26 to limit axial movement of the inner member 28 in a first direction relative to the outer member 26. Likewise, when assembled as shown in FIG. 2, second collar 60 and sleeve 58 limit axial movement of the inner member 28 relative the outer member 26 in a second direction. Thus, when assembled as shown in FIG. 2 the inner member 28 is secured within the outer member 26. However, limited axial movement of the inner member 28 relative the outer member 26 is permitted by the position of the first collar 30 and the sleeve 58 on the inner member. This limited axial movement allows for the inner member 28 to be dithered during make-up of the drill string 14 as disclosed in U.S. Pat. No. 7,628,226 issued to Mitchell et al., the contents of which are incorporated fully herein by this reference.

Figure 5:
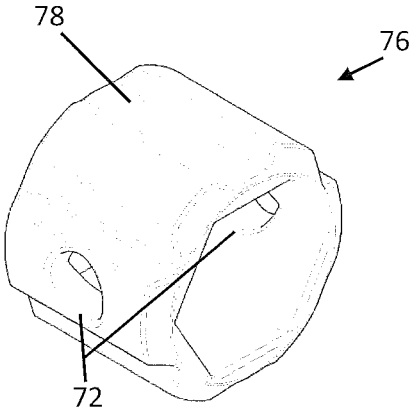
FIG. 5 is a perspective view of an alternative embodiment of the first removable collar.

Referring now to FIG. 5, an alternative first collar 76 is disclosed. Collar 76 is similar to collar 30. It has a polygonal inner profile sized to closely fit around the inner member 28 and counter bores 72. Likewise, collar 76 has a maximum cross-sectional dimension that exceeds the maximum cross-sectional dimension of the hollow region 32 of the outer member 26. However, the outer profile of first collar 76 differs from the outer profile of collar 30. The outer profile of collar 76 has a plurality of fluid passages 78 that extend from the first end to the second end of the collar. Fluid passages 78 are sized to allow drilling fluid to continue flowing axially through the annular space 66 (FIG. 8) when the first collar 76 has moved in the first direction to engage the shoulder 38 (FIGS. 2 & 8).

Figure 6:
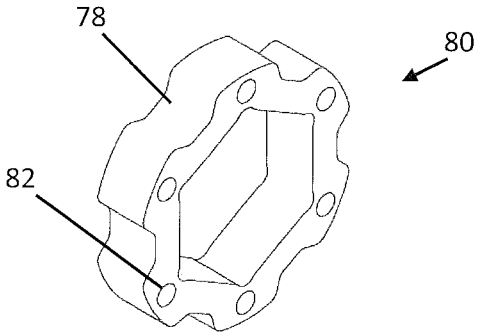
FIG. 6 is a perspective view of an additional alternative embodiment of the first removable collar.

An additional embodiment of the first collar is illustrated in FIG. 6. Collar 80 is similar to collar 76 and collar 30. It has a polygonal inner profile sized to closely fit around the inner member 28. It also has a maximum cross-sectional dimension that exceeds the maximum cross-sectional dimension of the hollow region 32 of the outer member 28. Collar 80 also has a plurality of axial fluid passages 78 formed in its outer profile. Collar 80 differs, however, from collars 30 and 76. Collar 80 is shorter than collars 30 and 76. It does not have counter bores 72. Thus, it may be welded to the inner member 28 rather than secured with fasteners 72. Collar 80 also has a plurality of axial fluid holes 82 to permit additional axial flow of drilling fluid through the collar. Collar 80 is disclosed herein to have six fluid holes 82 spaced evenly around the collar. Fluid passages 78 and fluid holes 82 allow drilling fluid to continue flowing axially down the drill string 14 to the boring tool 22 when the collar 80 has moved in the first direction to engage the shoulder 38 (FIG. 2).

Figure 7:
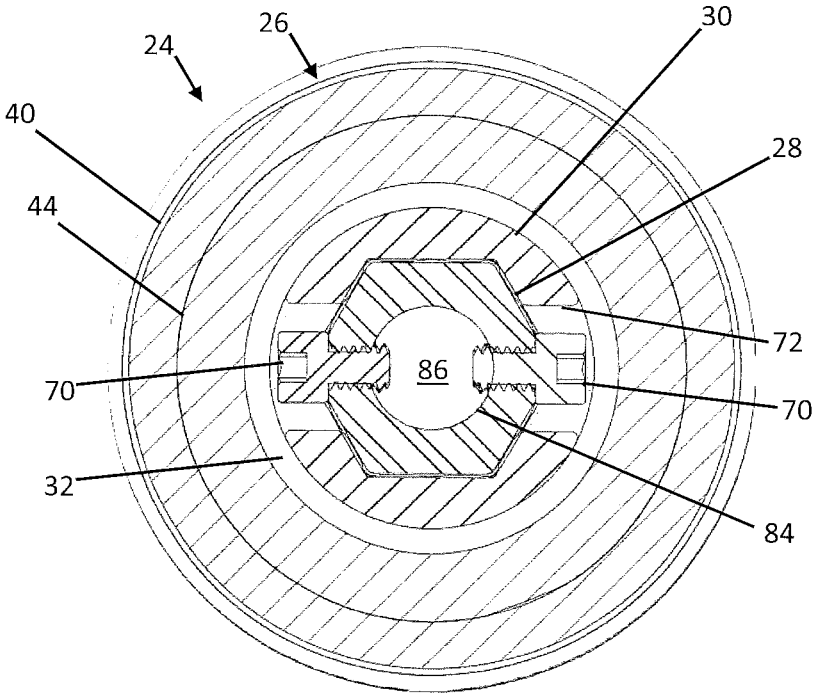
FIG. 7 is a cross-sectional view of the dual-member pipe assembly of FIG. 2 along line 7-7.

FIG. 7 provides a cross-sectional view of the pipe assembly 24 of FIG. 2 along line 7-7 looking toward the second end 36 of the outer member 26. As previously discussed, the box 44 is press fit within the cylindrical body 40 of the outer member. The hollow inner member 28 is contained within the outer member 26 and has a polygonal outer profile that is a regular hexagon. The inner member 28 has an internal profile 84 that is circular in cross-section and defines an internal drilling fluid flow passage 86. The collar 30 is supported on the inner member 28. The collar 30 has a circular outer profile and a polygonal inner profile that pairs with the polygonal outer profile of the inner member. The collar 30 is secured to the inner member with hex screws 70 positioned within counter bores 72. Hollow region 32 defines the annular space formed between the inner member 28 and the outer member 26 for the flow of drilling fluid from the drilling machine 20 to the boring tool 22.

Figure 9:
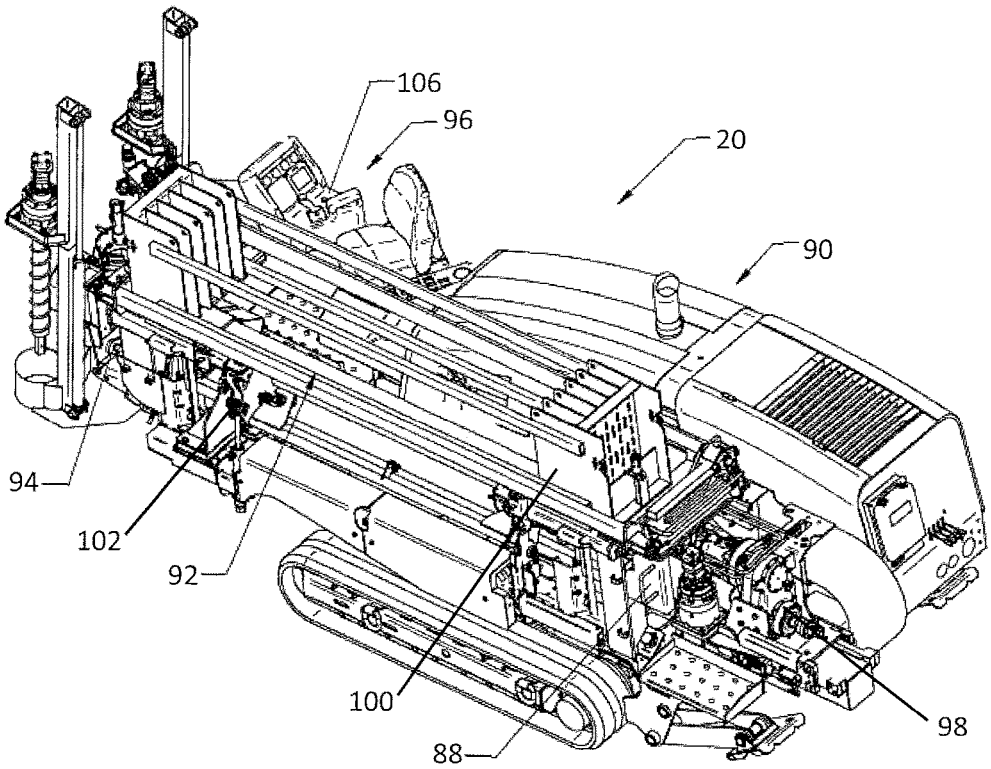
FIG. 9 is an enlarged view of the HDD machine used to drive operation of a dual-member drill string and the boring tool supported thereon.
Figure 10:
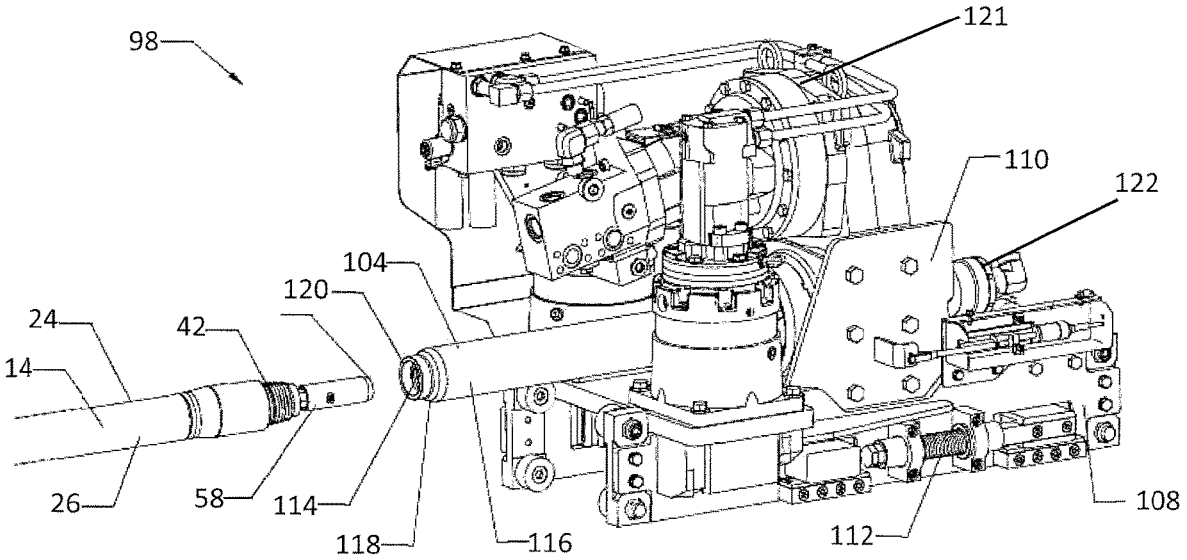
FIG. 10 is a view of the HDD machine drive system showing an uphole end of the dual-member drill string.

Turning now to FIG. 9, the HDD machine 20 of FIG. 1 is shown in greater detail. The HDD machine has a frame 88 that supports an engine 90, a pipe handling assembly 92, a make-up/breakout system 94, and an operator's station 96. The frame 88 also supports a carriage 98 that is movable from the back of the frame to the front of the frame along a track (not shown). The carriage 98 has a drive system that is used to rotate and thrust the drill string 14. The engine 90 is housed within an engine compartment. The engine provides the power required to thrust and rotate the boring tool via the inner and outer drive trains. The engine may comprise an internal combustion engine or an electric engine. The pipe handling assembly 92 comprises a magazine 100 and a shuttle system 102 used to transport the pipe assemblies 24 (FIG. 2) to and from the spindle 104 (FIG. 10). The make-up/breakout system 94 may have a plurality of hydraulically actuated vises that are used to thread and unthread the outer members 28 of the drill string. The operator's station 96 contains a control panel 106 having a display, joystick, and other machine function control mechanisms, such as switches and buttons. From the control panel 106, each of the functions of the HDD machine 20 can be controlled.

Turning now to FIG. 10 the carriage 98 is shown in greater detail. The carriage 98 generally comprises a carriage frame 108, a spindle carriage 110 supported on the carriage frame, and the spindle 104. The spindle carriage 110 is supported on the carriage frame 108 and provides rotation and thrust to the spindle 104. As used herein, thrust is intended to mean the advancement or retraction of the carriage 98. Preferably, the spindle carriage 110 is connected to the carriage frame 108 by a spring-centering device 112. The spring-centering device 112 biases the spindle carriage 110 to a default position relative to the carriage frame 108.

As depicted in FIG. 10, the carriage 98 is connected to the dual-member drill string 14 by way of the spindle 104. The dual-member drill string 14 is made up of the plurality of pipe assemblies 24. The spindle 104 comprises an inner spindle 114 and an outer spindle 116. The outer spindle 116 preferably comprises a threaded spindle pipe joint 118. The inner spindle 114 preferably comprises a spindle pipe joint 120 having an outer polygonal profile that pairs with the inner polygonal profile of the sleeve 58. The threaded spindle pipe joint 118 is adapted for connection to the pin 42 on the first end 34 of the outer member 26.

The outer spindle 116 is selectively rotated by an outer drive motor 121 supported on the carriage frame 108. The outer spindle 116, in turn, selectively rotates the plurality of outer members comprising the outer drive train to orient the steering feature of the boring tool. The inner spindle 114 is driven by an inner drive motor 122 also supported on the carriage frame 108. The inner spindle 114 is connected to the plurality of inner members 28 comprising the inner drive train via sleeve 58. The inner drive train is rotatable independent of the outer drive train and drives rotation of the drill bit.

The invention includes a kit comprising a plurality of elongate hollow outer members 26 and a plurality of elongate hollow inner members 28 used in a boring operation. Each inner member 28 is disposed within an associated outer member 26 and axially movable relative to that outer member. The kit also includes a plurality of any one of the first removable collars 30, 76, and 80 described herein. Each of the collars is sized to closely fit around an associated inner member 28 and is positioned to limit relative axial movement of that inner member and its associated outer member. A sleeve 58 is supported on the first end 52 of an associated inner member 28 adjacent to the first end 34 of the outer member 26. The sleeve 58 has opposed first and second ends and an inner profile that is hexagonal to pair with the outer profile of the inner member 28. The hexagonal inner profile of the sleeve 58 extends from its first end to its second end. As shown in FIG. 8, each sleeve 58 is configured to receive a pair of inner members 28 within its opposed ends. The sleeves 58 provide a slip-fit connection that transfers torque from inner member 28 to inner member 28 along the drill string 14.

In operation, a pipe assembly 24 is connected to the boring tool 22. The boring tool 22 may comprise housing and a bit that may be rotated relative to the housing. The housing is connected to the outer drive train. The bit is connected to the inner drive train.

The first end 16 of the drill string 14 is connected to the drill machine 20 as discussed with reference to FIG. 10. Motors 121 and 122 of the drive system are configured to drive independent rotation of the inner and outer drive trains and thrust the drill string 14 and boring tool 22 through the ground. When the carriage 98 has been thrust forward to reach the front of the machine 20 the carriage 98 is uncoupled from the first end 16 of the drill string 14 and returned to the back of the machine. A new pipe assembly 24 is moved from the magazine 100 to the spindle 104 and the first end of the pipe assembly 24 is coupled to the carriage 98. The carriage 98 is advanced slightly to the first end 16 of the drill string 14 and the second end of the new pipe assembly 24 is coupled to first end of the pipe assembly disposed at the first end of the drill string as shown in FIG. 8. The carriage 98 then thrusts and rotates the drill string 14 to advance the boring tool 22. When the carriage 98 reaches the front of the machine 20 the carriage is uncoupled from the drill string 14 and the process is repeated. This process is repeated until the boring tool 22 reaches an exit point.

Various modifications can be made in the design and operation of the present invention without departing from its spirit. Thus, while the principal preferred construction and modes of operation of the invention have been explained in what is now considered to represent its best embodiments, it should be understood that within the scope of the appended claims, the invention may be practiced otherwise than as specifically illustrated and described.

The invention claimed is:

1. A pipe assembly, comprising:

a pair of elongate hollow members capable of limited relative axial movement, and comprising:

an outer member; and an inner member at least partially nested within the outer member and cooperating with the outer member to define boundaries of an annular space, in which an outer surface of the inner member has a polygonal profile of uniform shape along a length of the inner member; and a collar supported on the inner member, in which the collar surrounds the inner member and is configured to limit relative axial movement between the inner member and the outer member and is traversed by a fluid passage that communicates with the annular space.

2. The pipe assembly of claim 1 in which the inner member has opposed first and second ends, the pipe assembly further comprising:

a sleeve positioned on the first end of the inner member, the sleeve having an inner profile that closely conforms to the outer profile of the inner member.

3. The pipe assembly of claim 2 in which the collar is positioned between the sleeve and the second end of the inner member.

4. The pipe assembly of claim 3 in which the collar is characterized as a first collar, the pipe assembly further comprising:

a second collar positioned between the sleeve and the second end of the inner member.

5. The pipe assembly of claim 2 in which the sleeve is secured to the inner member with a plurality of fasteners.

6. The pipe assembly of claim 1 in which the polygonal profile of the inner member extends along a length of the inner member from end-to-end.

7. The pipe assembly of claim 6 in which the polygonal profile has the shape of a regular hexagon.

8. The pipe assembly of claim 1 in which the collar is secured to the inner member with a plurality of fasteners.

9. The pipe assembly of claim 1 in which the collar has opposed front and rear surfaces that are joined by an outer peripheral surface, and in which the fluid passage is a groove formed in the outer peripheral surface and extending between the front and rear surfaces.

10. The pipe assembly of claim 1 in which the fluid passage is a hole.

11. The pipe assembly of claim 10 in which the inner member is receivable within a central opening formed in the collar, and in which the hole extends parallel to the central opening.

12. The pipe assembly of claim 1 in which the collar is removable from the inner member.

13. The pipe assembly of claim 1 in which the inner member has opposed first and second ends, and the collar is positioned entirely between the first and second end of the inner member.

14. A system comprising:

a drill string having a first end and a second end, comprising:

a plurality of the pipe assemblies of claim 1, arranged in end-to-end relationship, such that the outer members of the pipe assemblies form a torque-transmitting outer drive train, the inner members form a torque-transmitting inner drive train that is rotatable independently of the outer drive train, and the annular spaces form a fluid path within the drill string;

a horizontal directional drilling machine operatively engaged to the drill string at its first end; and a boring tool operatively engaged to the drill string at its second end.

15. The system of claim 14, further comprising:

a fluid within at least a portion of the fluid path.

16. The system of claim 14 in which the drilling machine comprises a drive system configured to drive independent rotation of the inner and outer drive trains.

17. A kit, comprising:

a plurality of pipe assemblies of claim 1; and a plurality of sleeves, each of which is positioned on an associated inner member and is configured to form a torque-transmitting connection between that inner member and an adjacent longitudinally aligned inner member.

18. The kit of claim 17 in which each of the sleeves has opposed first and second ends and an end-to-end inner profile that closely conforms to the outer profile of the inner member.

19. The kit of claim 17 in which each of the sleeves is attached to its associated inner member with a plurality of fasteners.

20. The kit of claim 17 in which each of the inner members has opposed first and second ends, and each of the collars is positioned entirely between the first and second end of its corresponding inner member.

21. A system comprising:

a drill string having a first end and a second end, comprising:

a plurality of pipe assemblies, each pipe assembly comprising:

a pair of elongate hollow members capable of limited relative axial movement, and comprising:

an outer member; and an inner member at least partially nested within the outer member and cooperating with the outer member to define boundaries of an annular space, in which an outer surface of the inner member has a polygonal profile of uniform shape along a length of the inner member; and a collar that surrounds the inner member, the collar configured to limit relative axial movement between the inner member and the outer member and traversed by a fluid passage that communicates with the annular space;

in which the plurality of pipe assemblies are arranged in end-to-end relationship, such that the outer members of the pipe assemblies form a torque-transmitting outer drive train, the inner members form a torque-transmitting inner drive train that is rotatable independently of the outer drive train, and the annular spaces form a fluid path within the drill string;

a horizontal directional drilling machine operatively engaged to the drill string at the first end; and a boring tool operatively engaged to the drill string at the second end.

22. A kit, comprising:

a plurality of pipe assemblies, each pipe assembly comprising:

a pair of elongate hollow members capable of limited relative axial movement, and comprising:

an outer member; and an inner member at least partially nested within the outer member and cooperating with the outer member to define boundaries of an annular space, in which an outer surface of the inner member has a polygonal profile of uniform shape along a length of the inner member; and a collar that surrounds the inner member, the collar configured to limit relative axial movement between the inner member and the outer member and traversed by a fluid passage that communicates with the annular space; and a plurality of sleeves, each of which is positioned on an associated inner member and is configured to form a torque-transmitting connection between that inner member and an adjacent longitudinally aligned inner member.

* * * * *